US012404142B2

(12) United States Patent
Geli et al.

(10) Patent No.: US 12,404,142 B2
(45) Date of Patent: Sep. 2, 2025

(54) SYSTEM AND METHOD FOR GUIDING FIBERS

(71) Applicant: Zoltek Corporation, Bridgeton, MO (US)

(72) Inventors: Maurice Geli, Chesterfield, MO (US); Arpad Rumy, Saint Peters, MO (US)

(73) Assignee: Zoltek Corporation, Bridgeton, MO (US)

( * ) Notice: Subject to any disclaimer, the term of this patent is extended or adjusted under 35 U.S.C. 154(b) by 728 days.

(21) Appl. No.: 17/632,430

(22) PCT Filed: Aug. 6, 2020

(86) PCT No.: PCT/US2020/045189
§ 371 (c)(1),
(2) Date: Feb. 2, 2022

(87) PCT Pub. No.: WO2021/026344
PCT Pub. Date: Feb. 11, 2021

(65) Prior Publication Data

US 2022/0281707 A1 Sep. 8, 2022

Related U.S. Application Data

(60) Provisional application No. 62/883,832, filed on Aug. 7, 2019.

(51) Int. Cl.
*B65H 57/16* (2006.01)
*B65H 57/06* (2006.01)
(Continued)

(52) U.S. Cl.
CPC ..... *B65H 57/16* (2013.01); *B65H 57/06* (2013.01); *B65H 57/12* (2013.01);
(Continued)

(58) Field of Classification Search
CPC ..... B65H 57/06; B65H 57/12; B65H 57/16; B65H 57/02; B65H 2701/314;
(Continued)

(56) References Cited

U.S. PATENT DOCUMENTS 3,151,021 A * 9/1964 Balch ..... D21F 11/00 242/157 R
4,393,793 A * 7/1983 Beasley ..... D05C 15/18 112/80.7
(Continued)

FOREIGN PATENT DOCUMENTS

CN 204778010 U 11/2015
CN 109629049 A 4/2019
(Continued)

OTHER PUBLICATIONS

International Preliminary Report on Patentability and Written Opinion for International Application No. PCT/US2020/045189, issued Feb. 8, 2022, 8 pages.
(Continued)

*Primary Examiner* — Anna M Momper
*Assistant Examiner* — Katelynne R Burrell
(74) *Attorney, Agent, or Firm* — Buchanan Ingersoll & Rooney PC

(57) ABSTRACT

A fiber guide that guides fibers in a fiber processing system. The fiber guide has a surface having apertures through which fibers can pass in a direction from an upstream side of the surface to a downstream side of the surface. The apertures include at least one pair of apertures adjacent to and spaced from one another. The inlet of the first aperture is offset from the inlet of the second aperture. The offset is in the direction in which the fibers pass from the upstream side of the surface to the downstream side of the surface. A distance (d1) between the inlet of the first aperture and the
(Continued)

inlet of the second aperture is larger than a distance (d2) between the first aperture and the second aperture measured transverse to the direction in which the fibers can pass.

5 Claims, 7 Drawing Sheets

(51) Int. Cl.
*B65H 57/12* (2006.01)
*D01H 13/04* (2006.01)
*D02J 1/18* (2006.01)

(52) U.S. Cl.
CPC ..... *D01H 13/045* (2013.01); *D02J 1/18* (2013.01); *B65H 2701/312* (2013.01); *B65H 2701/313* (2013.01); *B65H 2701/314* (2013.01)

(58) Field of Classification Search
CPC ..... B65H 51/015; B65H 2601/255; B65H 2601/273; D02J 1/18; D01H 13/045; D01H 13/12; D01H 4/40; D05C 15/18
See application file for complete search history.

(56) References Cited

U.S. PATENT DOCUMENTS

| | | | | |
|---|---|---|---|---|
| 7,506,831 | B1 | 3/2009 | Weiner | |
| 2006/0150379 | A1* | 7/2006 | Bruynoghe | B65H 57/12 28/212 |
| 2022/0282416 | A1* | 9/2022 | McComas | B65H 63/0324 |

FOREIGN PATENT DOCUMENTS

| | | | |
|---|---|---|---|
| JP | 2001-020145 | A | 1/2001 |
| JP | 2002-529613 | A | 9/2002 |
| WO | 00/27532 | A1 | 5/2000 |

OTHER PUBLICATIONS

International Search Report and Written Opinion for International Application PCT/US2020/045189, dated Oct. 21, 2020, 9 pages.
Office Action (Notice of Reasons for Rejection) issued Sep. 3, 2024, by the Japan Patent Office in corresponding Japanese Patent Application No. 2022-507521 and an English translation of the Office Action. (7 pages).

* cited by examiner

FIG. 1
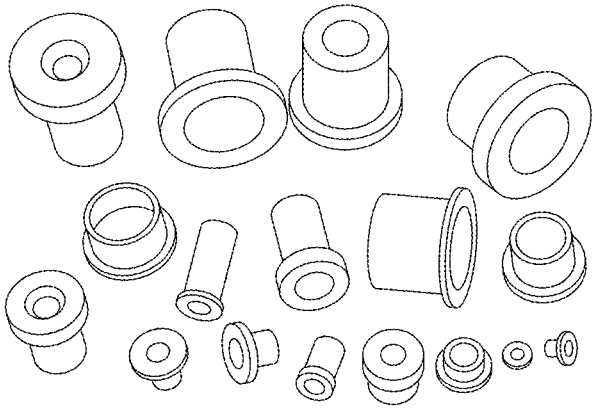
FIG. 2 - PRIOR ART
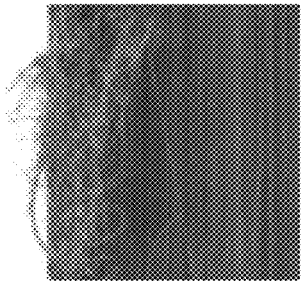
FIG. 3 - PRIOR ART
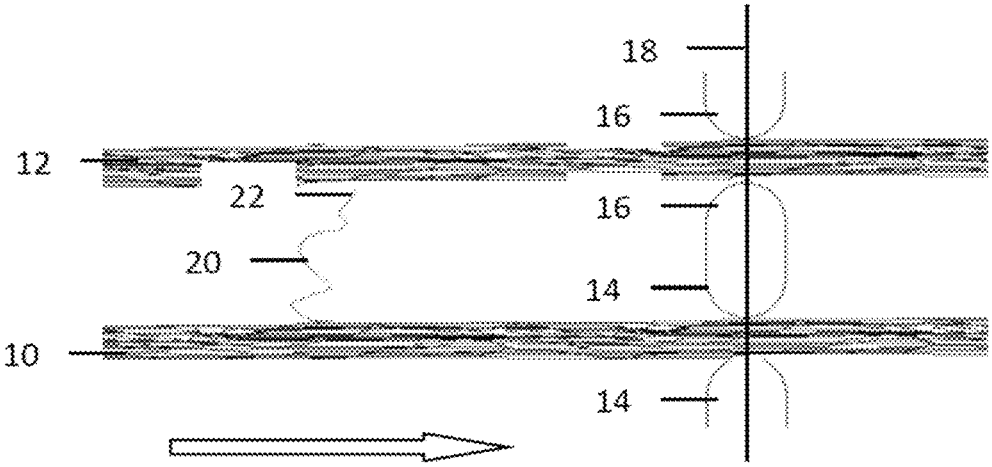

FIG. 4 - PRIOR ART
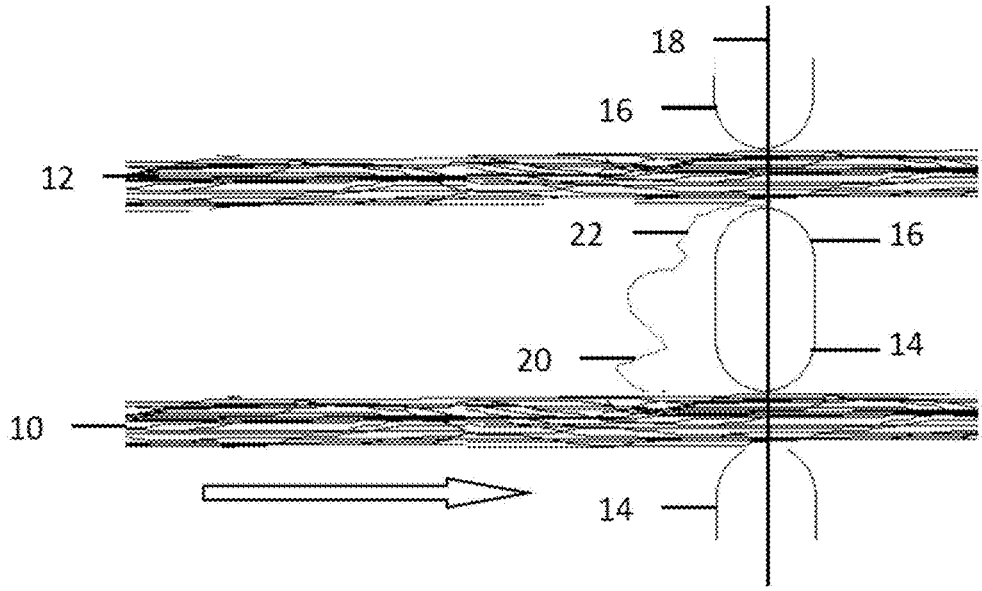
FIG. 5 - PRIOR ART
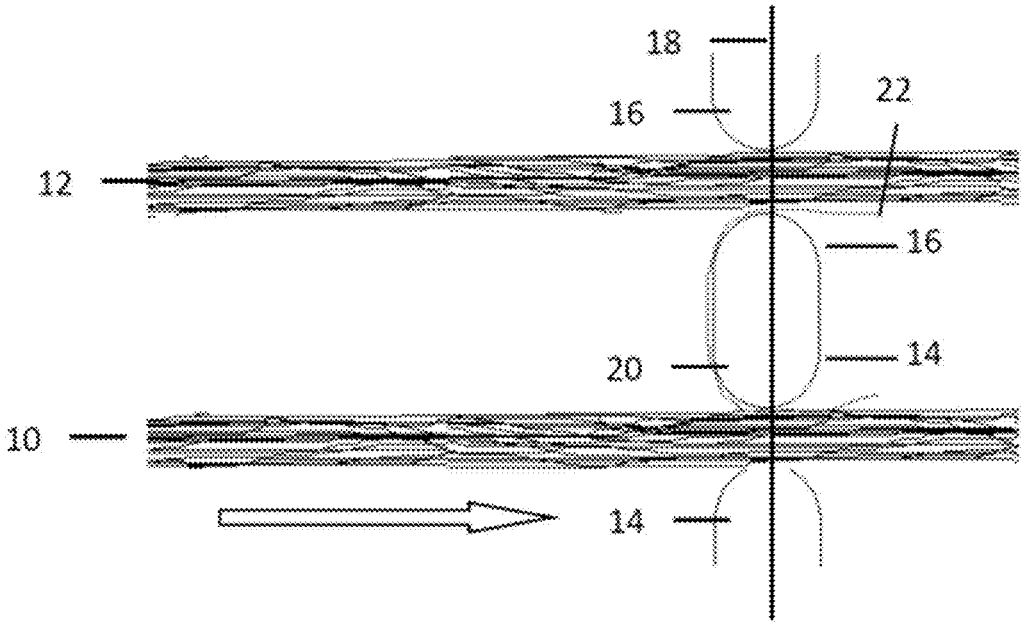

FIG. 6 - PRIOR ART
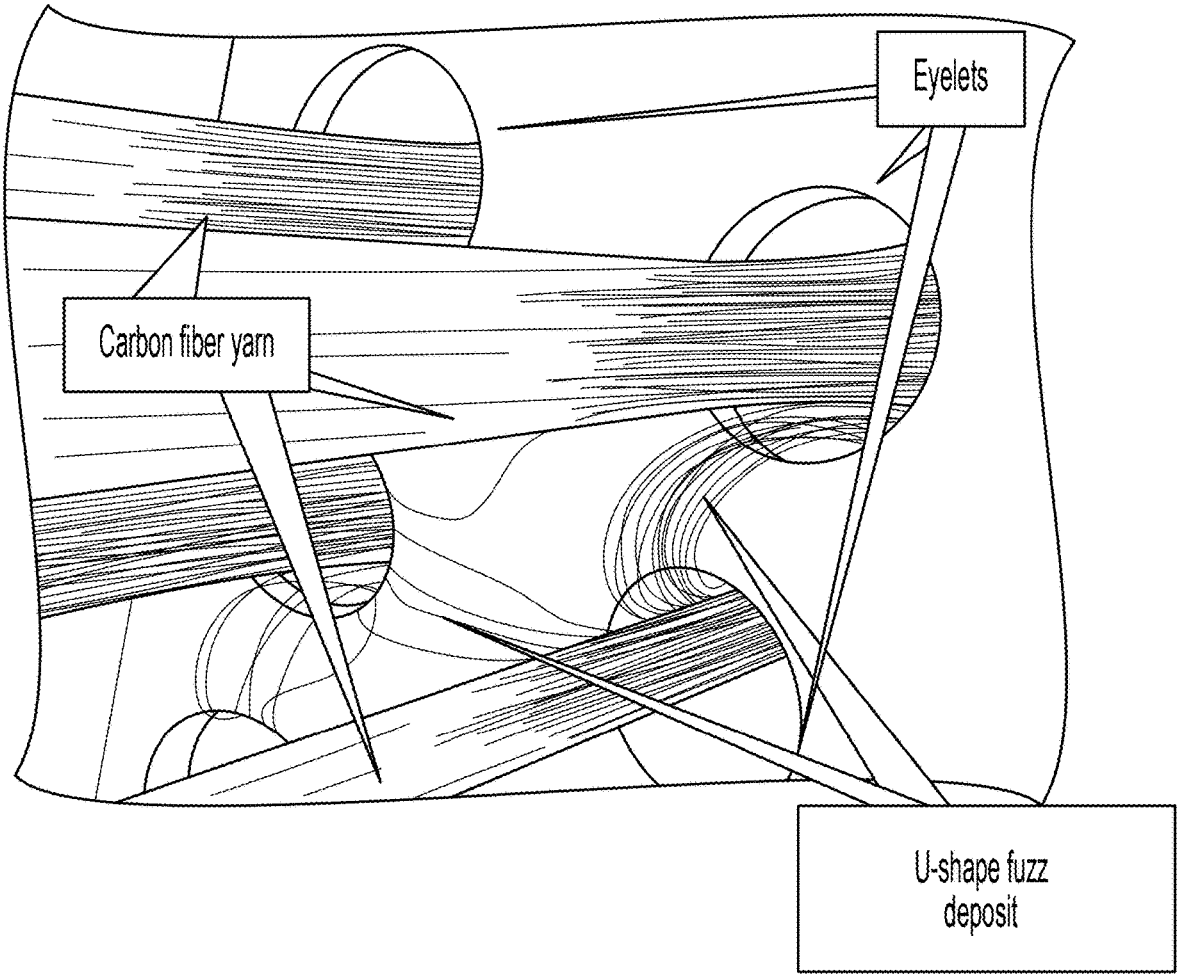

FIG. 7 - PRIOR ART
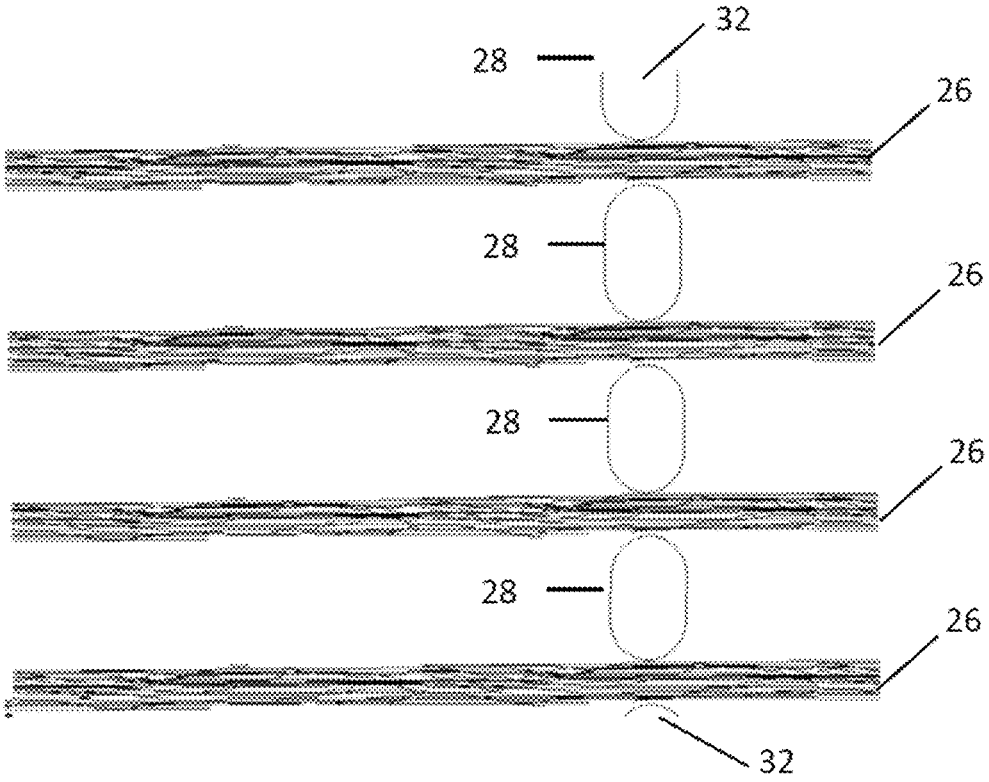

SYSTEM AND METHOD FOR GUIDING FIBERS

CROSS-REFERENCE TO RELATED APPLICATIONS

This application is the U.S. National Phase application of PCT International Application No. PCT/US2020/045189, filed Aug. 6, 2020, which claims priority to U.S. Provisional Patent Application No. 62/883,832, filed Aug. 7, 2019, entitled "SYSTEM AND METHOD FOR GUIDING FIBERS," the contents of each of which are incorporated herein by reference in their entireties.

FIELD OF THE INVENTION

This invention is in the field of fiber processing equipment, particularly for fibers intended to be used as reinforcement in fiber-reinforced composite materials.

BACKGROUND OF THE INVENTION

Fiber processing in an industrial setting requires moving fibers, usually in the form of a bundle of fibers, to be guided from one place to another. In the course of such movement, the moving fibers are often required to be guided by being in contact with at least one, and usually more than one unmoving guide, such as an eyelet, or other such guiding surface. The moving fibers thus come into contact with several such static points or surfaces. At those contact points, friction is present and delicate fibers in the bundle tend to break and thus a bundle of fibers (sometimes called a tow) can shred.

SUMMARY OF THE INVENTION

According to one aspect of the invention, a fiber guide configured to guide fibers in a fiber processing system is provided. The fiber guide includes a surface defining a plurality of apertures through which fibers can pass in a direction from an upstream side of the surface to a downstream side of the surface, each of the apertures having an inlet positioned to receive fibers from the upstream side of the surface. The plurality of apertures include at least one pair of first and second apertures adjacent to and spaced from one another. The inlet of the first aperture of the at least one pair of first and second apertures is offset from the inlet of the second aperture of the at least one pair of first and second apertures, the offset being in the direction in which the fibers can pass from the upstream side of the surface to the downstream side of the surface. A distance d1 between the inlet of the first aperture and the inlet of the second aperture is larger than a distance d2 between the first aperture and the second aperture measured transverse to the direction in which the fibers can pass.

BRIEF DESCRIPTION OF THE DRAWINGS

FIG. 1 shows examples of eyelets that can be used in embodiments of the present invention;

FIG. 2 shows broken fiber filaments;

FIGS. 3-5 show yarns running in parallel through eyelets;

FIG. 6 shows an eyelet board;

FIG. 7 shows yarns running in parallel through eyelets;

DETAILED DESCRIPTION OF THE INVENTION

Figure 8:
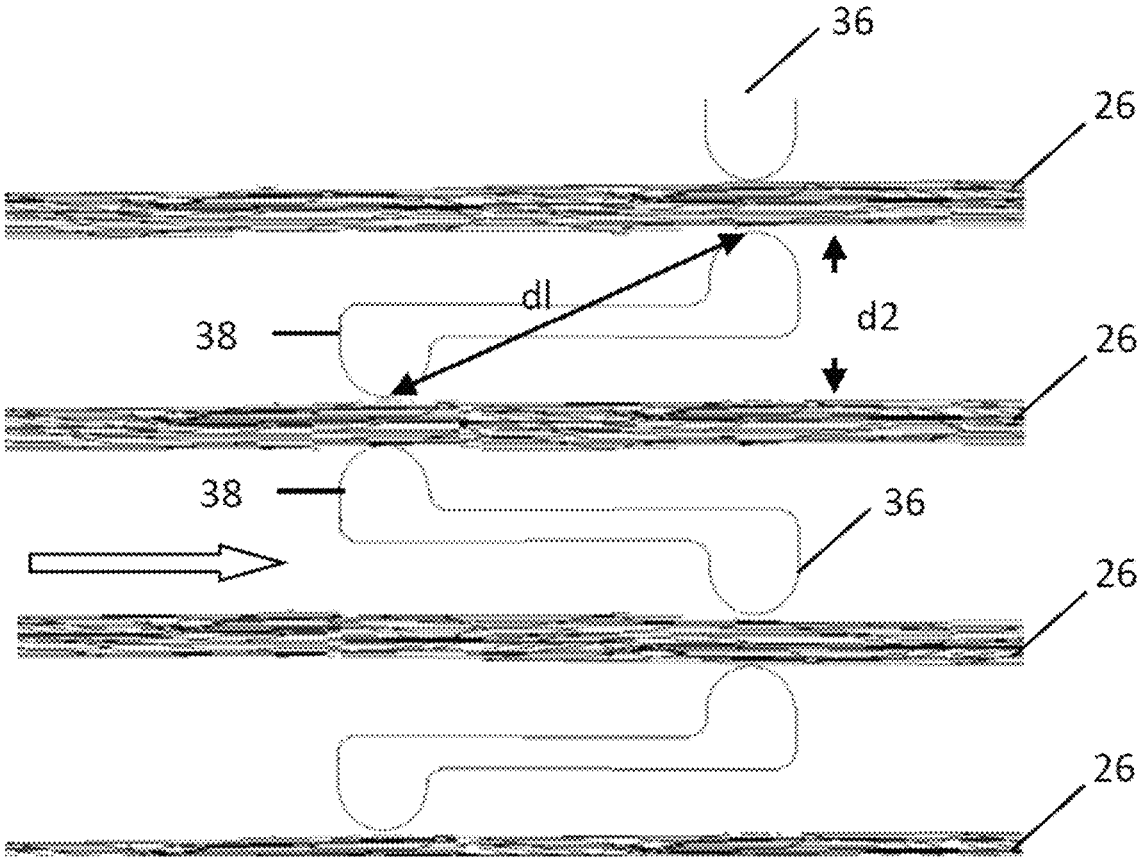
FIG. 8 shows an embodiment of an eyelet board according to aspects of the invention.

This invention provides a fiber guide that reduces the fuzz or fluffs and single fiber or yarn or tow breakage and the accompanying deposit and accumulation during the processing of fibers, such as fibers that are used to reinforce composite materials. The fiber guide includes a series of apertures, which may be lined with or have mounted therein, eyelets. The apertures are placed in specified relation to each other. The eyelets themselves have a geometry and material properties.

In the production of fiber reinforced composite materials more specifically, fiber may be glass fiber, carbon fiber, aramid fiber, basalt fiber, or other fiber materials. Those fibers are typically in the form of single yarn, or tow, which is composed of single filaments of fiber. While being processed, as described above, those single filaments tend to break, which causes shredding of the fiber bundle, whether in the form of tow or yarn.

The shredded fibers, in the form of "fuzz" or "fluff," tend to accumulate and then sometimes break off. The accumulations thus may travel downstream with the fiber bundle, collecting on the processing equipment. Furthermore, the fiber breakage represents lost raw material, which is an economic problem. Thus, this invention provides a way to minimize this fiber breakage, without interfering with the operation of existing fiber processing equipment.

Composite materials require a high number of tows or yarns, each comprised of a bundle of individual fibers, to be processed together. For good performance, yarn should be individually guided. One frequent solution to gather fiber in a specific shape is to use a surface, such a board, in which a number of apertures are formed. The fiber, in form of filaments, or tow or yarn are thus fed through the apertures in the board to guide them in the fiber processing operation. These apertures thus each define a guide surface for each tow or yarn. These apertures may be typically defined by or lined with "eyelets" which act as individual guide surfaces for each tow or yarn. In the discussion that follows, the terms "aperture" and "eyelet" should be understood to refer to types of structures that define an opening or guide opening in the eye board through which the fibers pass during processing.

FIG. 1 shows a photograph of a number of various exemplary such eyelets. Although these exemplary eyelets are all generally circular in cross-section, other cross-sectional shapes are possible, such as a square, rectangle, semicircle, etc. Further, while these eyelets are generally annular, they may be open on one side as well, e.g., "U" shape or "C" shape in cross-section, either with curved or straight sides.

The placement of apertures which may be lined with these eyelets in relation to each other on the eye board has been discovered to play a role in the amount of fiber that breaks. These factors will be described in detail in the description that follows.

Regarding the relative position of the apertures/eyelets with respect to adjacent (proximal) eyelets, these eyelets are mounted into the "upstream" side, i.e., the entry of the apertures in the board, and thus a number of tows or yarns may be guided in the same direction during fiber processing. Those boards are also called "eye boards."

As mentioned briefly above, deposits of so-called "fuzz" or "fluffs" of fibers tend to accumulate on these eye boards. This accumulation results in disruption of the fiber processing line. This accumulation of fiber on the eye boards that guide the fiber from spools on a creel is a problem in fiber processing and manufacture of fiber reinforced composites because when the accumulation of the fuzz is substantial, it moves with the fibers downstream towards the next steps in the composite manufacturing line. When the fiber tow/yarn which has the fuzz accumulation arrives at a location for downstream processing, the fiber in the tow/yarn bundle that is attached to the fuzz accumulation can break, and then the neighboring fiber can break as well.

FIG. 2 is a photograph of the beginning stages of such fuzz or fluff accumulation on a bundle of filaments of fiber, e.g. tow, or yarn. As can be seen in the photograph, the fuzz comprises a number of individual broken fiber filaments as a result of the tow shredding at the contact points (usually the eyelets)

The typical fuzz accumulation deposit process on the eye board is as follows:

Step 1 is shown schematically in FIG. 3. Two bundles of fibers 10, 12, also called yarns, or tows, run in parallel, in the direction of the arrow, into separate apertures, which may be lined with eyelets 14, 16 shown schematically in cross-section. These eyelets are mounted on the same surface, in this case a board, also referred to as an eye board 18. A single broken filament 20 has broken from the yarn 10. Note that a first end 22 of the filament 20 is free at this point, while the rest of filament 20 is still entrained within the bundle of fibers in the tow 10.

Step 2 is shown schematically in FIG. 4. As shown in FIG. 4, when the first end 22 of the broken filament 20 gets close to the upstream side of an adjacent eyelet or aperture 16 in the eye board 18, the broken filament end 22 is pinched between the adjacent yarn or tow 12 which is moving through eyelet 16. As shown in FIG. 4, the arrow shows the direction in which the tows 10 and 12 are moving. The free end 22 is thus entrained into the adjacent tow 12 and the rest of the single fiber 20, being entrained in the tow 10, is pulled along with the rest of the tow 10.

Step 3 is shown schematically in FIG. 5. Because the free end 22 is pinched between eyelet 16 and the tow 12, the other end of the fiber 20 is pulled through eyelet 14 by the rest of the tow 10. As shown in FIG. 5, the fiber 20 therefore deposits in between the two eyelets 14 and 16. By repeating these Steps 1 to 3 over and over, fibers 20 will build up between the two adjacent eyelets 14 and 16, thereby causing a large amount of fuzz to build up, which takes the form of a U or a bridge between the two eyelets, that is, adjacent apertures in the eye board surface. One can appreciate that the cycle of breakage tends to accelerate, since when more fibers are built up, the friction on the eyelet or the aperture increases, thereby causing more fibers to break as they are pulled across the broken fibers trapped in the eyelet or aperture.

FIG. 6 is a photograph of an example of such U-shaped fuzz that has built up between two such adjacent apertures lined with eyelets in a surface of an eye board. In addition to the immediate problem of these fuzz deposits causing loss of fiber over time, when fuzz deposit size becomes too large the entire deposit will move with the tow or yarn and will badly impact the next step of the fiber processing operation. For instance, fuzz accumulates at eyelets, and it bridges between two holes. When fuzz accumulation gets big, it finally moves with the tow. When reaching a downstream slot plate, it cannot pass through and will start to shred the fiber, and then the neighboring one, and thus tows are lost.

Surprisingly, the inventors have determined that this phenomenon tends to disappear significantly if a distance between two apertures/eyelets that are proximal to each other is longer than the length of a broken single filament. Typically, this minimum distance is 1 inch or 2.5 cm for a typical carbon fiber such as P35 carbon fibers available from Zoltek Corporation. But in most of the cases the purpose of the eye board is to guide or gather the yarns more closely together, since they will be formed into shapes, or woven or other steps needed to from a composite, in downstream processing. Thus, the distance between yarn/tow in the eyelets in the apertures should be considerably smaller than 2.5 cm, e.g. smaller than 20 mm, or smaller than 19 mm, 18 mm, or smaller than 17 mm, or smaller than 16 mm, or smaller than 15 mm, or smaller than 14 mm, or smaller than 13 mm, or smaller than 12 mm, or smaller than 11 mm, or smaller than 10 mm, or smaller than 9 mm, or smaller than 8 mm, or smaller than 7 mm, or smaller than 6 mm, or smaller than 5, mm, or smaller than 4 mm, or smaller than 3 mm, or smaller than 2 mm, or even smaller than 1 mm.

This invention is thus directed in certain embodiments to a fiber guide that minimizes the fuzz or fluffs and the single fibers in the yarn that break and result in these fuzz/fluff deposits and accumulation. The inventors have determined that alternated offset inlet apertures of the eye board allow the fiber tows to be gathered more closely together, while at the same time minimizing the build-up of fuzz/fluff due to broken fibers.

An example of the relevant geometry is shown schematically in FIG. 7, which is a side cross-sectional view of a number of tows/yarns 26 passing through eyelets/apertures 28 in an eye board 32. FIG. 8 shows a side cross-sectional view of exemplary offset pairs of eyelets/apertures mounted in an eye board 34. As can be seen in FIG. 8, which is an embodiment according to an aspect of the invention, the yarn/tows 26 are guided through eyelets 36 and eyelets 38, which are offset from adjacent eyelets 36.

As shown in FIG. 8, the offset between eyelets/apertures 36 and eyelets/apertures 38 can be defined by the distances d1 and d2. In order for the accumulation of fuzz/fluff due to fiber breakage to be minimized, the distance d1 between the inlets of the first apertures 36 and the second apertures 38 is larger than a distance d2, which is measured transverse to the direction, shown by the arrow, in which the fibers tows/yarns 26 pass. For avoidance of doubt, these distances d1 and d2 may be considered to be measured from the upstream ends of the adjacent apertures where they guide the entering fibers. In the embodiment shown in FIG. 8, this is the location at which the passage opening of the aperture is smallest. Thus, the diameter of the apertures will not be a factor in measuring these distances.

Without being bound by theory, it may be that when one set of eyelets is offset from another, adjacent set of eyelets, the fuzz cannot deposit because the U shape or bridge is de-equilibrated, so not even the first broken filament end can deposit, and thus the cycle of acceleration of broken fibers never gets started.

Figure 9:
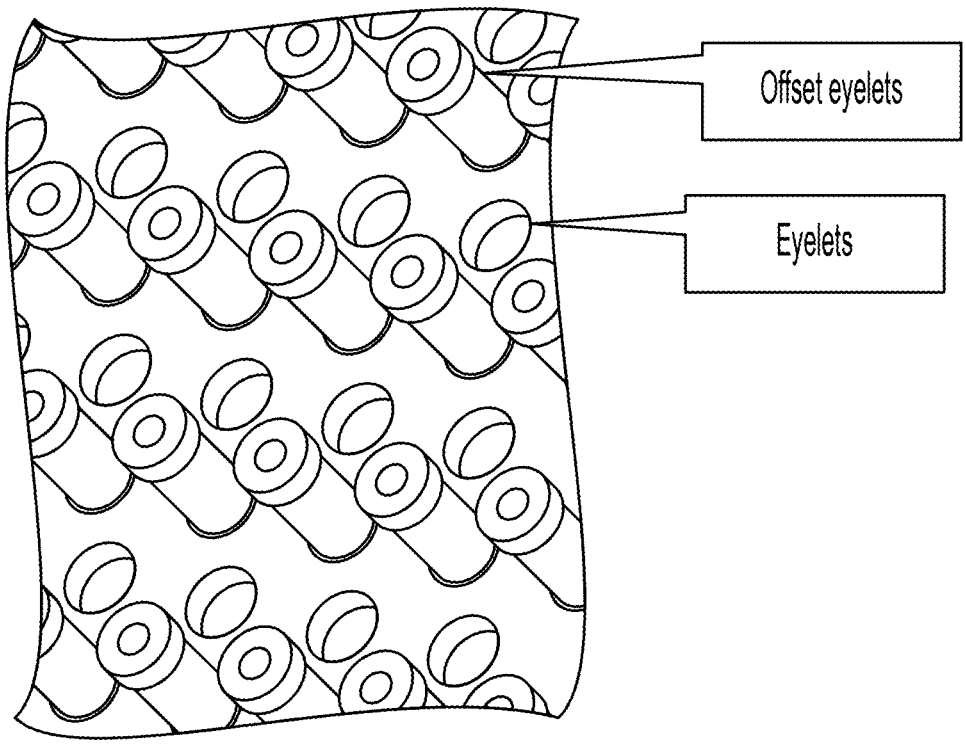
FIG. 9 shows another embodiment of an eyelet board according to aspects of the invention.

FIG. 9 shows a photograph of an exemplary such eye board that utilizes the offset eyelets in the apertures of the eye board surface that guides the tows of fibers. Example 1 (below) shows the results in terms of fuzz accumulation in grams/hour from the eye board shown in FIG. 6, compared to the amount of fuzz collected from the eye board shown in FIG. 9.

Exemplary Aspects of the invention are as follows:

Aspect 1: A fiber guide configured to guide fibers in a fiber processing system, the fiber guide comprising:

a surface defining a plurality of apertures through which fibers can pass in a direction from an upstream side of the surface to a downstream side of the surface, each of the apertures having an inlet positioned to receive fibers from the upstream side of the surface;

the plurality of apertures including at least one pair of first and second apertures adjacent to and spaced from one another;

the inlet of the first aperture of the at least one pair of first and second apertures being offset from the inlet of the second aperture of the at least one pair of first and second apertures, the offset being in the direction in which the fibers can pass from the upstream side of the surface to the downstream side of the surface, wherein a distance d1 between the inlet of the first aperture and the inlet of the second aperture is larger than a distance d2 between the first aperture and the second aperture measured transverse to the direction in which the fibers can pass.

Aspect 2: The fiber guide of Aspect 1, further comprising a board defining the surface and a plurality of eyelets coupled to the board at positions corresponding to selected apertures, wherein the eyelets define the inlet of the selected apertures.

Aspect 3: The fiber guide of any of Aspects 1 and 2, wherein the inlet of the first aperture is offset from the surface of the board.

Aspect 4: The fiber guide of any of Aspects 1-3, wherein the distance d1 between the inlet of the first aperture and the inlet of the second aperture is 1 inch or larger and the distance d2 between the first aperture and the second aperture measured transverse to the direction in which the fibers can pass is less than 1 inch.

Aspect 5: A fiber processing system comprising:

a source of fibers; and a fiber guide positioned downstream from the source of fibers, the fiber guide being configured to guide fibers as the fibers are received from the source of fibers, the fiber guide including:

a surface defining a plurality of apertures through which the fibers can pass in a direction from an upstream side of the surface to a downstream side of the surface, each of the apertures having an inlet positioned to receive a portion of the fibers from the upstream side of the surface;

the plurality of apertures including at least one pair of first and second apertures adjacent to and spaced from one another;

the inlet of the first aperture of the at least one pair of first and second apertures being offset from the inlet of the second aperture of the at least one pair of first and second apertures, the offset being in the direction in which the fibers can pass from the upstream side of the surface to the downstream side of the surface, thereby increasing a distance d1 between the inlet of the first aperture and the inlet of the second aperture as compared to a distance d2 between the first aperture and the second aperture measured transverse to the direction in which the fibers can pass.

Aspect 6: The fiber processing system of Aspect 5, the fiber guide further comprising a board defining the surface and a plurality of eyelets coupled to the board at positions corresponding to selected apertures, wherein the eyelets define the inlet of the selected apertures.

Aspect 7: A system for guiding fibers traveling along substantially parallel paths between an upstream location and a downstream location, the system comprising:

a fiber guide defining at least one pair of fiber guide passages, the fiber guide being positioned between the upstream location and the downstream location;

each of the fiber guide passages having a guide opening configured to receive a portion of the fibers when the fibers are traveling between the upstream location and the downstream location, and each of the guide openings being defined by a guide surface;

wherein the fiber guide passages of the pair of fiber guide passages are spaced from one another but positioned proximal to one another;

wherein the guide surface of the guide opening of one of the fiber guide passages of the pair of fiber guide passages is proximal to the guide surface of the guide opening of the other one of the fiber guide passages of the pair of fiber guide passages; and wherein the position of the guide surface of the guide opening of one of the fiber guide passages of the pair of fiber guide passages is positioned upstream in a direction along the paths relative to the guide surface of the guide opening of the other one of the fiber guide passages of the pair of fiber guide passages.

Aspect 8: A method for guiding fibers in a fiber processing system, the method comprising:

passing fibers through apertures defined in a surface in a direction from an upstream side of the surface to a downstream side of the surface, each of the apertures having an inlet positioned to receive a portion of the fibers from the upstream side of the surface;

maintaining at least one pair of first and second apertures adjacent to and spaced from one another such that the inlet of the first aperture of the at least one pair of first and second apertures is offset from the inlet of the second aperture of the at least one pair of first and second apertures, the offset being in the direction in which the fibers pass from the upstream side of the surface to the downstream side of the surface, thereby increasing a distance d1 between the inlet of the first aperture and the inlet of the second aperture as compared to a distance d2 between the first aperture and the second aperture measured transverse to the direction in which the fibers pass.

Aspect 9: The method of Aspect 8, further comprising passing fibers through apertures defined in a board and eyelets coupled to the board at positions corresponding to selected apertures, wherein the eyelets define the inlet of the selected apertures.

Aspect 10: A method for configuring a fiber guide to reduce fiber deposits in the fiber guide, the fiber guide having a surface defining a plurality of apertures through which the fibers can pass in a direction from an upstream side of the surface to a downstream side of the surface, the method comprising:

maintaining at least one pair of first and second apertures adjacent to and spaced from one another;

offsetting the inlet of the first aperture of the at least one pair of first and second apertures from the inlet of the second aperture of the at least one pair of first and second apertures, the offset being in the direction in which the fibers pass from the upstream side of the surface to the downstream side of the surface, thereby increasing a distance d1 between the inlet of the first aperture and the inlet of the second aperture as compared to a distance d2 between the first aperture and the second aperture measured transverse to the direction in which the fibers pass.

Aspect 11: The method of Aspect 10, further comprising coupling eyelets to a board at positions corresponding to selected apertures, wherein the eyelets define the inlet of the selected apertures.

EXAMPLES

Example 1: Fuzz Accumulation in Grams/Hour from the Eye Board Shown in FIG. 6, Compared to the Amount of Fuzz Collected from the Eye Board Shown in FIG. 9

Fiber was run through the eye board shown in FIG. 6 (not having offset neighboring eyelets) for one hour. Fiber was then run through the eye board shown in FIG. 9 (having offset neighboring eyelets) for one hour. When each line was stopped, the fuzz that accumulated on each type of board was weighed and compared. The process conditions and the results are shown in Tables 1 and 2, respectively.

TABLE 1

Process conditions for Example 1:

| Fiber | ZOLTEK ™ PX35 carbon fiber, available from Zoltek Corporation |
|---|---|
| Line Speed, cm/minute | 66.0 |
| Eyelet diameter, cm | 1.3 |
| Distance between eyelets measured transverse to fiber direction (d2), cm | 2.5 |
| Eyelet offset - i.e. distance the offset eyelets protrude from board in FIG. 9, cm | 2.5 |
| Distance between top of inlets of adjacent eyelets (d1), cm | 3.6 |

TABLE 2

Comparison of fuzz accumulation between eye boards having offset eyelets and not having offset eyelets.

| | Fuzz accumulation in gm/hour yarn |
|---|---|
| With offset eyelets | 0.0012 |
| Without offset eyelets | 0.0040 |

As can be seen in Table 2, using the offset eyelets resulted in approximately three-fold reduction in the amount of fuzz accumulated on the eye board.

Example 2: Longer Term Experiment on Effect of Offset Eyelets

Figure 10:
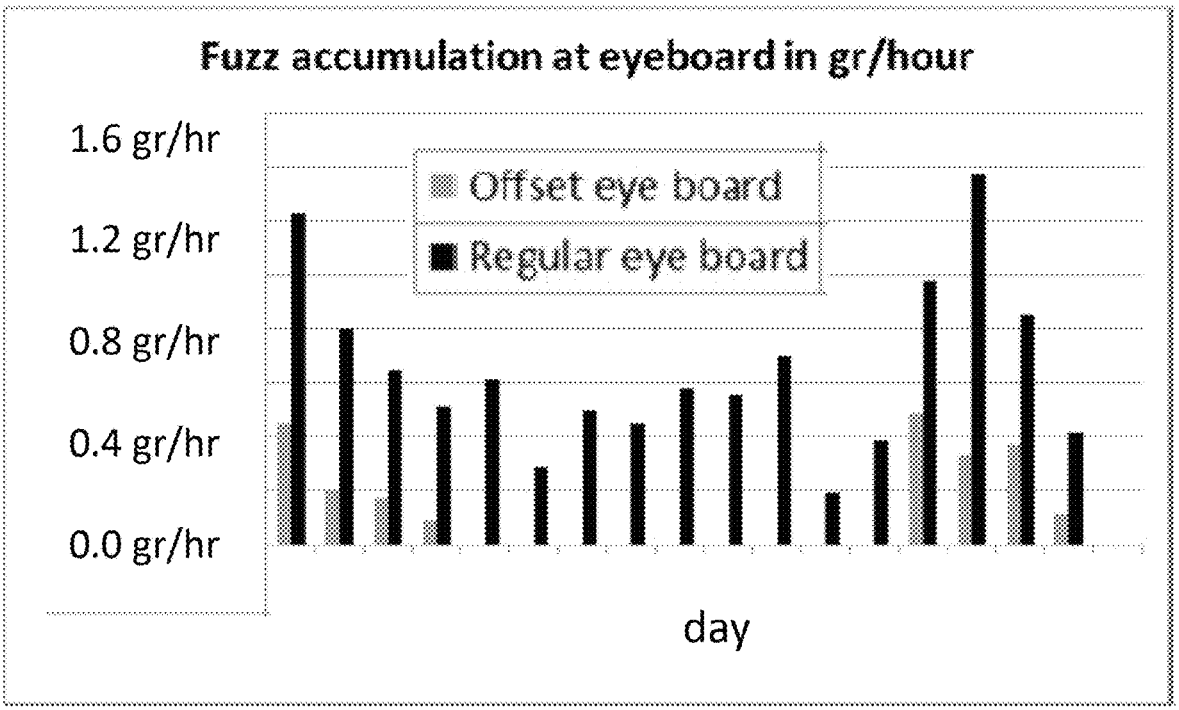
FIG. 10 shows the results of fuzz collection over time.

Next, an experiment similar to Example 1 was carried out, but the two eye boards (with and without adjacent eyelets) were used on two separate fiber lines for 18 days. The fuzz was collected every two hours and the average grams per hour for each day were calculated. These data are shown in FIG. 10 for each date. Note that on January 5, the line using the eye boards having the offset eyelets went down for reasons unrelated to the fuzz accumulation on the eye boards. However, when the line was operating, the global trend for the offset eyelets was clearly lower fuzz accumulation than the non-offset eyelets. Over the course of the experiment (for days when both lines were running), approximately 73% less fuzz was accumulated on the line utilizing the offset eyelets. Note also that the amount of fuzz generated appeared to decrease over time for the offset eyelets, which may be attributable to a start up effect.

Regarding Examples 1 and 2, it is apparent that fuzz accumulation on the eye board is greatly reduced (−73%) by using offset eyelets.

Although the invention is illustrated and described herein with reference to specific embodiments, the invention is not intended to be limited to the details shown. Rather, various modifications may be made in the details within the scope and range of equivalents of the claims and without departing from the invention.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A fiber guide configured to guide fibers in a fiber processing system, the fiber guide comprising:

a surface defining a plurality of apertures through which fibers can pass in a direction from an upstream side of the surface to a downstream side of the surface, each of the apertures having an inlet positioned to receive fibers from the upstream side of the surface;

the plurality of apertures including at least one pair of first and second apertures adjacent to and spaced from one another;

the inlet of the first aperture of the at least one pair of first and second apertures being offset from the inlet of the second aperture of the at least one pair of first and second apertures, the offset being in the direction in which the fibers can pass from the upstream side of the surface to the downstream side of the surface, wherein a distance (d1) between the inlet of the first aperture and the inlet of the second aperture is larger than a distance (d2) between the first aperture and the second aperture measured transverse to the direction in which the fibers can pass;

a board defining the surface and a plurality of eyelets coupled to the board at positions corresponding to selected apertures, wherein the eyelets define the inlet of the selected apertures, and wherein the inlet of the first aperture is offset from the surface of the board.

2. A fiber processing system comprising a source of fibers and a fiber guide of claim 1, wherein the fiber guide is positioned downstream from the source of fibers and configured to guide fibers as the fibers are received from the source of fibers.

3. A system for guiding fibers traveling along substantially parallel paths between an upstream location and a downstream location, the system comprising the fiber guide of claim 1 positioned between the upstream location and the downstream location.

4. A method for guiding fibers in a fiber processing system, the method comprising:

passing fibers through the apertures of the fiber guide of claim 1, the inlet being positioned to receive at least a portion of the fibers from the upstream side of the surface;

maintaining the at least one pair of first and second apertures adjacent to and spaced from one another such that the inlet of the first aperture of the at least one pair of first and second apertures is offset from the inlet of the second aperture of the at least one pair of first and second apertures.

5. A method for configuring the fiber guide of claim 1 to reduce fiber deposits in the fiber guide, the method comprising:

maintaining the at least one pair of first and second apertures adjacent to and spaced from one another; and offsetting the inlet of the first aperture of the at least one pair of first and second apertures from the inlet of the second aperture of the at least one pair of first and second apertures.

* * * * *